US005193230A

United States Patent [19]

Guerty

[11] Patent Number: 5,193,230

[45] Date of Patent: Mar. 16, 1993

[54] AUTOMATIC TOILET SEAT LOWERING APPARATUS

[76] Inventor: Harold G. Guerty, 14161 69th Dr. North, Palm Beach Gardens, Fla. 33418

[21] Appl. No.: 795,721

[22] Filed: Nov. 21, 1991

[51] Int. Cl.[5] ..... A47K 13/04

[52] U.S. Cl. ..... 4/246.2; 4/248; 188/310

[58] Field of Search ..... 4/246.1, 246.2, 248; 188/310

[56] References Cited

U.S. PATENT DOCUMENTS

| | | | |
|---|---|---|---|
| 2,004,910 | 6/1935 | Fieldman | 188/310 X |
| 2,009,677 | 7/1935 | Pennington | 188/310 X |
| 3,781,924 | 1/1974 | Davis, Jr. | 4/246.2 |
| 4,291,422 | 9/1981 | Shoemaker et al. | 4/246.2 |
| 4,491,989 | 1/1985 | McGrail | 4/246.1 |
| 4,853,983 | 8/1989 | Grant | 4/246.2 |
| 4,914,757 | 4/1990 | Johnson | 4/224 |

FOREIGN PATENT DOCUMENTS

| | | | |
|---|---|---|---|
| 3701720 | 8/1988 | Fed. Rep. of Germany | 4/248 |

*Primary Examiner*—Charles E. Phillips
*Attorney, Agent, or Firm*—Quarles & Brady

[57] ABSTRACT

A toilet seat lowering apparatus includes a housing defining an internal cavity for receiving water from the water supply line to the toilet holding tank. A descent delay assembly of the apparatus can include a stationary dam member and a rotating dam member for dividing the internal cavity into an inlet chamber and an outlet chamber and controlling the intake and evacuation of water in a delayed fashion. A descent initiator is activated when the internal cavity is filled with pressurized water and automatically begins the lowering of the toilet seat from its upright position, which lowering is also controlled by the descent delay assembly.

15 Claims, 5 Drawing Sheets 8
28
30
32
34
36
38
40
42
44
45
46
48
50
52
54
56
58
60
68
70
71
72
74
76
78
80
82
84
86
88
90
92
94
104
106

FIG. 3
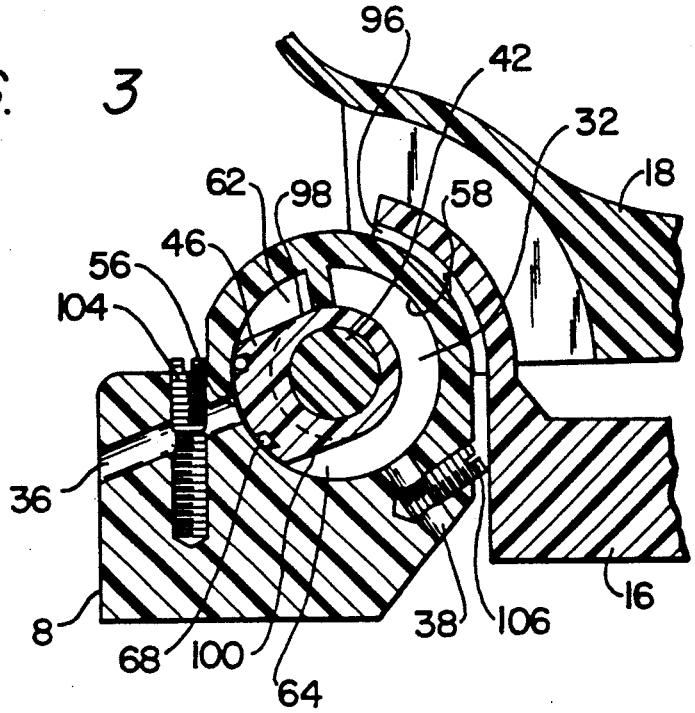
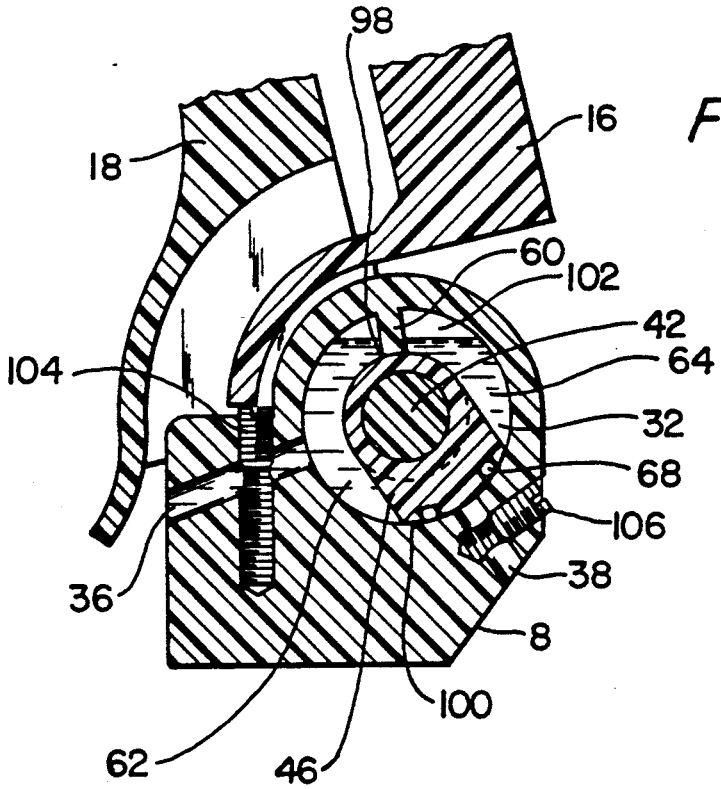
FIG. 4

AUTOMATIC TOILET SEAT LOWERING APPARATUS

BACKGROUND OF THE INVENTION

The present invention relates generally to toilet accessories. More particularly, the invention relates to devices for lowering toilet lid and seat members from an upright position to a lowered position, resting on the associated toilet bowl rim.

Mechanized systems, based on spring biased cams, gears and other mechanical components, are known for lowering toilet seats. These systems generally require tight tolerances, engineered to match particular seat sizes and weights. The tight tolerances create difficulties in manufacturing and can cause malfunction due to worn components.

Hydromechanical systems have been developed to lower toilet seats utilizing water as an operating agent. However, some of these systems continue to rely on mechanized components requiring tight tolerances. Other systems maintain operating fluid after use, thereby increasing the risk of unmonitored leakage.

SUMMARY OF THE INVENTION

It is an object of the invention to provide a toilet seat lowering apparatus which is easy to install on a conventional toilet.

It is another object of the invention to provide a toilet seat lowering apparatus which operates automatically.

It is still another object of the invention to provide a toilet seat lowering apparatus which can operate independently of flushing of the toilet.

It is a further object of the invention to provide a toilet seat lowering apparatus which uses few parts and requires little maintenance.

It is a still further object of the invention to provide a toilet seat lowering apparatus which minimizes the possibility of leakage when not in use.

It is yet another object of the invention to provide a toilet seat lowering apparatus which is constructed to softly lower the toilet seat and prevent it from impacting the toilet bowl rim with high force.

These and other objects of the invention are achieved by apparatus for automatically lowering a toilet seat of a conventional toilet from an upright position to a lowered position, resting on an associated toilet bowl rim. The automatic lowering of the toilet seat is accomplished independent of flushing of the toilet, and the apparatus is constructed to delay the lowering of the toilet seat for a period of time after the toilet seat is raised to its upright position.

The lowering apparatus generally includes a housing which is mountable on the rear upper surface of a toilet bowl between the holding tank and the bowl opening. The housing has an internal cavity which encloses a toilet seat descent delay assembly. The descent delay assembly is constructed to divide the internal cavity into an inlet chamber and an outlet chamber.

A water inlet passage is formed in the housing to supply water from a water source to the inlet chamber. Similarly, a water evacuation passage is formed in the housing to permit the drainage of water from the outlet chamber. The descent delay assembly provides leakage passages for allowing fluid to pass between the inlet chamber and the outlet chamber.

One member of the descent delay assembly is rotatably mounted in the internal cavity and can provide sealing means which is rotated to alternatingly seal the water inlet passage and the water evacuation passage during operation.

The descent delay assembly provides mounting ends which extend from opposite ends of the housing and attach to hinge flanges of the toilet seat so that the toilet seat is rotationally fixed relative to the descent delay assembly. When the toilet seat is in its lowered, resting position, the descent delay assembly is rotated so that the sealing means covers the water inlet passage and prevents the introduction of water to the internal cavity. Upon raising the toilet seat to its upright position, the descent delay assembly is rotated so that the sealing means uncovers the water inlet passage and seals the water evacuation passage.

When the toilet seat is raised, water enters the inlet chamber and is leaked through the leakage passages of the descent delay assembly to fill the outlet chamber. The time necessary for the water to fill both chambers and additionally to compress air trapped in the chambers delays the actuation of a toilet seat descent initiating means.

Adjustment means can also be provided to control the extent of delay. The adjustment means are readily accessible after installation to enable the user to control delay time and adapt the apparatus to various seat sizes and weights. Thus, the matching tolerances of internal components, such as those of the descent delay assembly, need not be tightly specified, reducing manufacturing costs and chances of potential malfunction.

The descent initiating means can include a push pin mounted on a piston that reciprocates in a piston chamber in fluid communication with the internal cavity. The push pin extends outside the housing to engage a rear portion of the toilet seat. As the chambers of the internal cavity and the piston chamber are filled, water pressure is generated to raise the piston, causing the push pin to engage a rear portion of the toilet seat, thereby rotating the toilet seat from its upright position to descend under its own weight.

After the toilet seat descent has begun, the descent delay assembly is rotated so that the water evacuation passage is open, thereby allowing drainage of water in the outlet chamber. Because water remains in the inlet chamber, a pressure differential is created across the descent delay assembly. This pressure differential resists the descent of the toilet seat, thereby reducing the speed of the descent and associated force of impact between the toilet seat and the toilet bowl rim, and softly resting the toilet seat on the toilet bowl rim.

The lowered toilet seat causes a corresponding rotation of the descend delay assembly so that the sealing means covers the water inlet passage and prevents further intake of water. The remaining water in the inlet and outlet chambers is subsequently drained through the water outlet passage. The lowering apparatus does not maintain fluid which can leak when the apparatus is not in use.

Thus, the present invention provides an automatic toilet seat lowering apparatus which can operate independently of the flushing of the associated toilet. The lowering apparatus utilizes water flow to initiate and control the lowering of the toilet seat, but avoids the disadvantages of a stored fluid in its internal cavity and reduces manufacturing costs by relieving tolerance requirements.

BRIEF DESCRIPTION OF THE DRAWINGS

A more thorough understanding of the invention can be gained by a reading of the following detailed description of the preferred embodiments in connection with the associated drawings, in which:

FIG. 3 is a sectional view along line 3—3 in FIG. 1, showing a configuration of the toilet seat lowering apparatus when the toilet seat is lowered;

FIG. 4 is a sectional view, along line 3—3 in FIG. 1, showing a configuration of the toilet seat lowering apparatus when the toilet seat is raised;

DETAILED DESCRIPTION OF THE PREFERRED EMBODIMENTS

Figure 1:
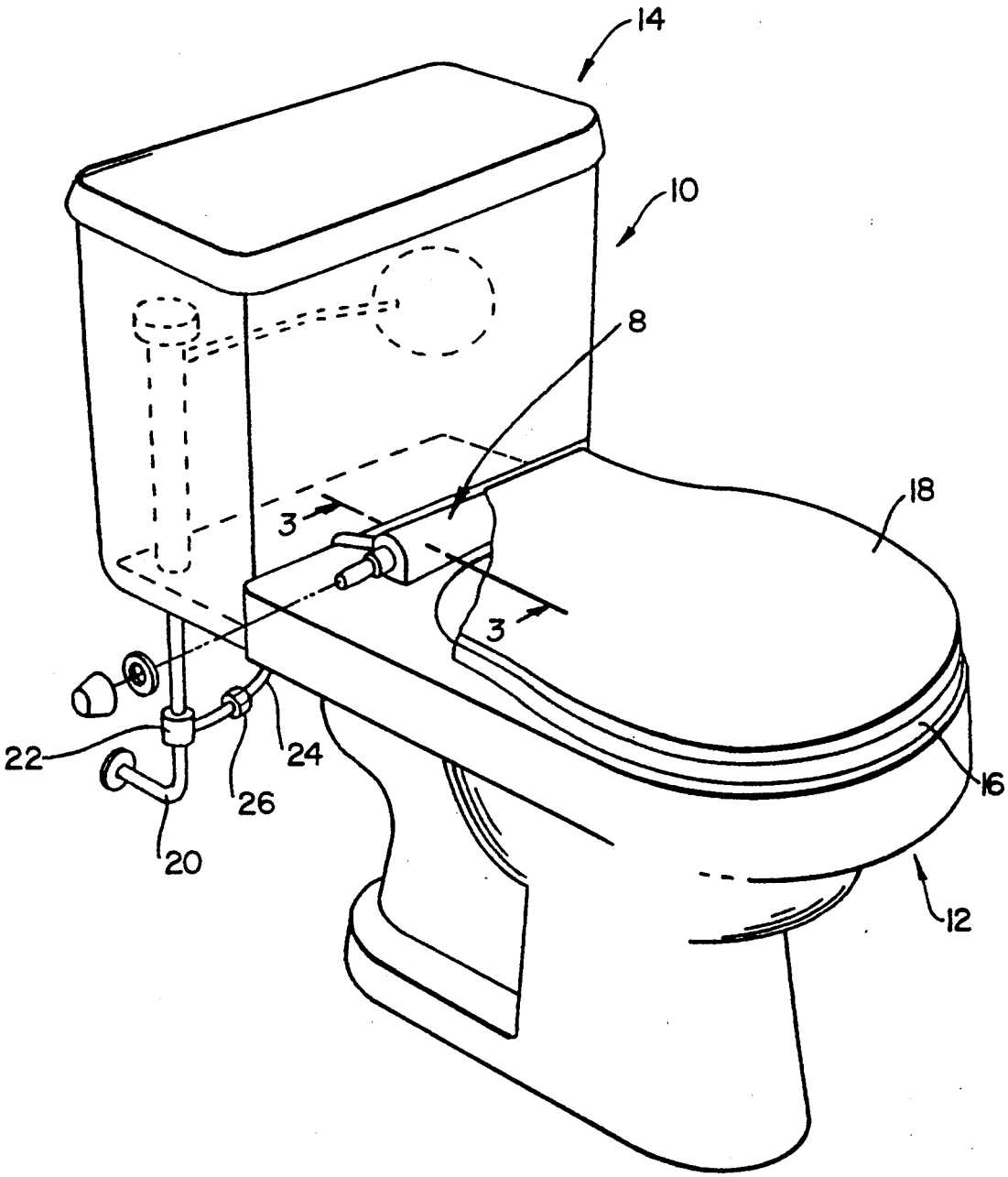
FIG. 1 is a perspective view of a conventional toilet equipped with the toilet seat lowering apparatus of the invention.

Referring now to the drawings, the present invention resides in apparatus for automatically lowering a toilet seat of a conventional toilet after the toilet seat has been raised to its vertical, upright position. The lowering apparatus is constructed to automatically delay the lowering of the toilet seat to its resting position on the toilet bowl rim, and the automatic lowering of the toilet seat is preferably accomplished independently of the flushing of the toilet.

Referring to FIG. 1, a housing 8 of the lowering apparatus is conveniently mounted to the top surface of a toilet bowl 12 of a conventional toilet 10 between the holding tank 14 and the toilet seat 16 and lid 18. The apparatus is connected to the rear of the toilet seat 16 and the toilet lid 18, which cover the opening of the toilet bowl 12.

A water supply line 20, which provides water to the holding tank 14, can be fitted with a T-fitting 22 to additionally supply water to the lowering apparatus. A feed line 24 from the T-fitting 22 to the lowering apparatus can also be provided with an emergency shut-off valve 26 for discontinuing the flow of water to the lowering apparatus.

The shut-off valve 26 on the feed line 24 permits operation of the toilet seat 16 independently of the toilet seat lowering apparatus. When the water supply is disconnected by the valve 26, the toilet seat can be raised and lowered manually in a conventional fashion.

Figures 2, 2A, 2B:
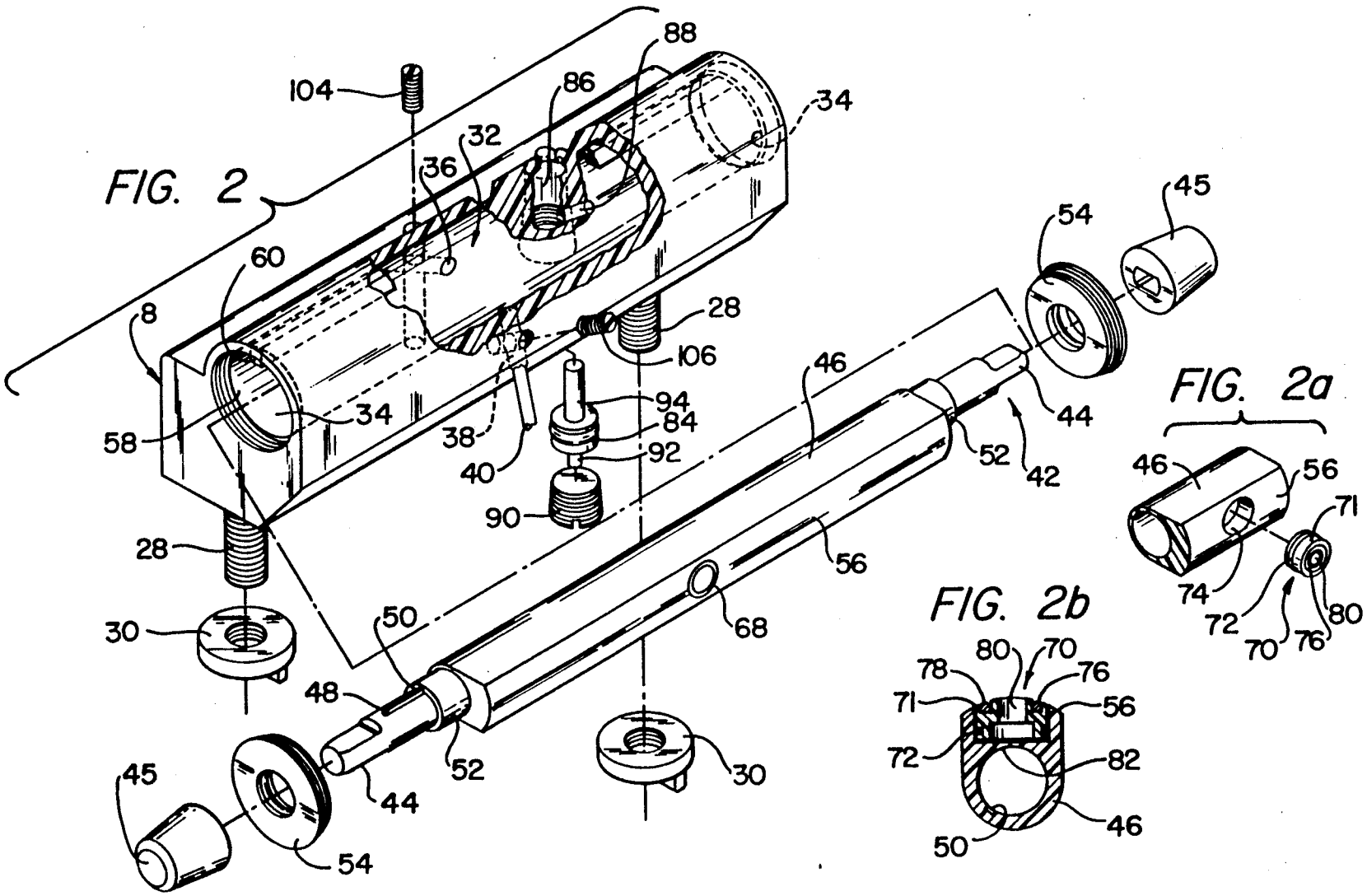
FIG. 2 is an exploded, perspective view of the toilet seat lowering apparatus of FIG. 1.
FIG. 2*a* is a perspective view of an alternative seal for the toilet seat lowering apparatus.
FIG. 2*b* is a side sectional view thereof.

Referring to FIG. 2, the toilet seat lowering apparatus of the invention generally includes the housing 8, a toilet seat descent initiating means, and a toilet seat descent delay assembly. The descent delay assembly is constructed not only to delay the activation of the descent initiating means, but also to control the rate of descent of the toilet seat as it lowers to reduce the likelihood that the seat will forcefully impact against the rim of the toilet bowl 12.

A housing 8 can be constructed as a generally cylindrical body having a flat bottom surface for flush mounting on the top surface of the toilet bowl 12. The housing 8 can be securely mounted to the top surface of the toilet bowl 12 by inserting studs 28 through mating holes in the top surface and tightening lock nuts 30.

The housing 8 has an internal cavity 32, which is preferably elongated and cylindrical. The internal cavity 32 terminates in openings 34 at opposite ends of the housing 8.

A water inlet passage 36 is formed in the rear side of the housing 8 to connect the internal cavity 32 to a water source, such as through the water feed line 24 (see FIG. 1). Similarly, a water evacuation passage 38 is formed in the front side of the housing 8 to permit evacuation of water from the internal cavity 32. Evacuation tubing 40 can extend from the water evacuation passage 38 to drain the water into the toilet bowl 12.

The toilet seat descent delay assembly preferably includes a mounting shaft 42 which extends through the internal cavity 32 and has mounting ends 44 for connection to the toilet seat 16 and the toilet lid 18. Preferably, the mounting ends 44 are formed to lockingly engage the toilet seat 16 so that the toilet seat 16 and the mounting shaft 42 rotate together. The toilet lid 18 is preferably mounted to freely rotate relative of the mounting shaft 42 to allow manual raising and lowering.

The mounting ends 44 can be flattened, as shown, to matingly insert into corresponding holes in standard toilet seat hinge flanges. Alternatively, the holes of the toilet seat hinge flanges can be rounded and filled with a plug or other locking member to rotationally fix the hinge flanges relative to the mounting shaft 42. The mounting ends 44 can be protectively covered by caps 45.

The mounting shaft 42 inserts through the center of a rotating dam member 46, which controls the passage of water in the cavity 32, and is constructed to be rotationally fixed relative to the rotating dam member 46. Preferably, the mounting shaft 42 provides a longitudinal key 48 to engage a corresponding keyway 50 in the rotating dam member 46, although other methods for rotationally fixing the components can be used.

The rotating dam member 46 extends longitudinally in the internal cavity 32 and is suspended along the central axis of the internal cavity 32 by the engagement of its plug ends 52 with threaded housing end caps 54, which close the openings 34 of the internal cavity 32. Because the rotating dam member 46 is securely supported and aligned by the plug ends 52 and the housing end caps 54, the mounting shaft 42 can be conveniently removed to remove or exchange the toilet lid 18 or toilet seat 16 without affecting the sealed assembly of the rotating dam member 46 within the internal cavity 32.

When assembled, the eccentrically mounted rotating dam member 46 extends radially from the central axis of the internal cavity 32 and terminates in a sweeping face 56 proximate the cylindrical wall 58 of the internal cavity 32 so that there is a slight leaking clearance or passage 98 between the sweeping face 56 and the cylindrical wall 58. (See FIG. 3). Generally opposite the radial extension of the rotating dam member 46, a stationary dam member 60 extends radially inwardly from the internal cylindrical wall 58 and terminates proximate the central axis of the internal cavity 32 so that another slight leaking clearance or passage 100 is defined between the stationary dam member 60 and the rotating dam member 46. (See FIG. 4).

Together, the rotating dam member 46 and the stationary dam member 60 divide the internal cavity 32 into an inlet chamber 62 and an outlet chamber 64. (See FIG. 4). The volumes of the respective chambers are varied as the rotating dam member 46 rotates in the internal cavity 32. (Compare FIGS. 3 and 4).

The sweeping face 56 of the rotating dam member 46 is preferably equipped with a sealing member, such as an 0-ring 68. The sealing member is aligned along the length of the internal cavity 32 with the water inlet passage 36 and the water evacuation passage 38 and can be disposed to alternatingly seal each of the passages 36 and 38 by rotation of the rotating dam member 46. The 0-ring 68 can be disposed in a corresponding circular groove on the sweeping face 56 and constructed to protrude radially from the sweeping face 56 to sealingly contact the cylindrical wall surface 58 surrounding the passages 36 and 38.

Because the sweeping face 56 is curved to generally match the contour of the cylindrical wall 58 of the internal cavity 32, the generally planar surface of the 0-ring 68 may not seat properly during rotation of the rotating dam member 46. Referring to FIGS. 2*a* and 2*b*, the seal member is therefore preferably constructed to use the pressure of incoming water in the water inlet passage 36 to more securely seal when the sweeping face 56 is positioned over the water inlet passage 36.

Referring to FIG. 2*a* and FIG. 2*b*, a seal insert 70 includes a generally circular body 71 having an annular sealing ring 72 around its periphery for sealingly inserting in a corresponding hole 74 in the sweeping face 56 of the rotating dam member 46. The outer surface of the body 71 is generally curved to match the curved surface of the sweeping face 56 and provides a circular groove 76 for receiving an 0-ring 78. Through the center of the body 71, a bore 80 extends to the opposite side of the body 71. The diameter of the bore 80 expands near the opposite side to form an annular shelf 82.

When the seal insert 70 is positioned over the water inlet passage 36, pressurized water flows through the bore 80 to the opposite side of the seal insert 70. The water is prevented from escaping around the sides of the seal body 71 by the sealing ring 72, and therefore exerts pressure on the annular shelf 82, urging the seal insert 70 and supported 0-ring 78 toward the water inlet passage 36, thereby creating a tighter, more reliable seal. The pressure exerted on the seal insert 70 by the water also serves to center and seat the seal insert 70.

Figure 5:
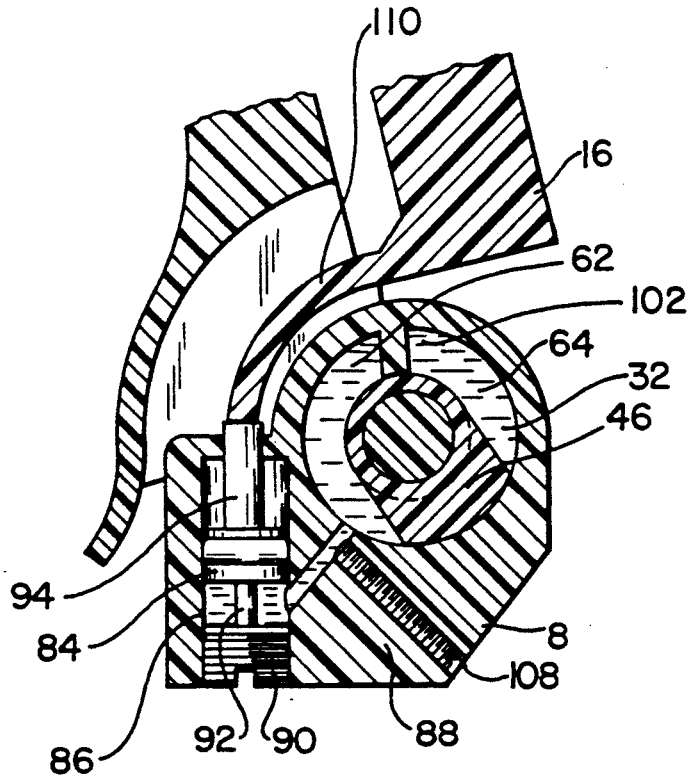
FIG. 5 is a sectional view of FIG. 1 at a different axial location from that shown in FIGS. 3 and 4, illustrating the operation of one possible toilet seat descent initiating assembly.

Referring to FIG. 5, the lowering apparatus also includes toilet seat descent initiating means. Preferably, the descent initiating means includes a piston 84 slidingly disposed in a piston chamber 86 formed in the housing 8. A piston chamber passage 88 permits the flow of water from the internal cavity 32 to the piston chamber 86. The piston chamber 86 can be opened from the bottom of the housing 8 and is sealed by a piston chamber plug 90. The piston 84 can be supported above the piston chamber plug 90 by a spacer post 92 so that the piston chamber passage 88 is not blocked by the piston 84.

A push pin 94 extends from an upper surface of the piston 84 through an opening in the housing 8 to engage a rear portion of the toilet seat 16, such as a rear arm 110 The raising of the piston 84 causes the push pin 94 to engage and rotate the toilet seat 16 from its upright position and begin the lowering process.

OPERATION

FIGS. 3–5 cross-sectionally illustrate the operation of a preferred embodiment of the lowering apparatus. Referring to FIG. 3, when the toilet seat 16 is positioned in its lowered, sitting position, a hinge flange 96 connected to the mounting shaft 42 causes the rotating dam member 46 to cover the water inlet passage 36. When the lowering apparatus is in this non-use orientation, the internal cavity 32 is exposed to outside air through the water evacuation passage 38. Water supplied to the water inlet passage 36 is prevented from entering the inlet chamber 62 and the outlet chamber 64 by the sealing member 68 on the sweeping face 56 of the rotating dam member 46.

Referring to FIG. 4, when the toilet seat 16 is rotated to its upright position, the rotating dam member 46 and the associated sealing member 68 are rotated from the water inlet passage 36 to cover and seal the water evacuation passage 38, thereby sealing the internal cavity 32 and capturing air 102 within both chambers 62 and 64. High pressure water enters the inlet chamber 62 where it is leaked past the leakage passages 98, 100 formed between the rotating dam member 46 and the stationary dam member 60 and the internal wall 58, respectively, to enter the outlet chamber 64.

The leakage passages 98, 100 are a preferred feature of the invention. In other hydrodynamic toilet seat control systems, sealing between chambers is necessary. The sealing typically requires tight tolerances and the use of separate seals to achieve the sealing relationship. These sealed surfaces may not be reliable as components wear. The leakage passages 98, 100 can be formed by the inherent spacing between the assembled components, and relatively relaxed manufacturing tolerances can be employed as sealing is not required.

Differences from part to part in the flow areas defined by the leakage passages 98 and 100 due to the use of standard production tolerances can be compensated by adjusting the inlet passage area with an adjustment screw 104 to obtain an inlet passage area greater than the leakage areas defined by the passages 98 and 100, thereby creating a positive pressure in the inlet chamber 62 at all times during operation.

Because the seal member 68 covers the water evacuation passage 38, the inlet chamber 62 and outlet chamber 64 are filled and pressurized to the supply pressure of the incoming water. As water fills both chambers 62 and 64, the captured air 102 is also compressed until the chamber pressure is equivalent to the water supply pressure. The time required for the water to fill both chambers 62 and 64 by passing through the leakage clearances 98, 100 of the stationary dam member 60 and the rotating dam member 46 and the time necessary to compress the captured air 102 provide a delay in the activation of the descent initiating means.

Referring to FIG. 5, while the inlet chamber 62 and outlet chamber 64 are filled, the piston chamber 86 is simultaneously filled with water through the piston chamber passage 88. However, the fluid in the piston chamber 86 is not completely pressurized until the inlet chamber 62 and outlet chamber 64 are completely filled and the captured air 102 is compressed. The pressurization of the water in the piston chamber 86 can be further delayed by adjusting the constriction in the piston chamber passage 88 with an adjusting screw 108.

When the inlet chamber 62 and outlet chamber 64 are filled, the captured air 102 is compressed and the piston chamber 86 is pressurized, the piston 84 and associated push pin 94 are raised to engage the rear portion of the toilet seat 11, such as the rear arm 110. The rising push pin 94 engages the rear arm 110 and rotates the toilet seat 16 forward from its upright position.

During this initial stage of the lowering process, the water pressure on opposite sides of the rotating dam member 46 are essentially equal, thereby limiting the resistance to downward rotation of the toilet seat 16 to water displacement. Lowering under its own weight, the toilet seat 16 encounters minimum resistance at this stage and its descent rate is maximum.

Descent adjusting means can also be provided to control the rate of descent. The inlet adjusting screw 104 which extends across the water inlet passage 36 can be further adjusted to vary the flow area to the inlet chamber 62 relative to the leakage flows at the passages 98 and 100 to raise or lower the pressure in the inlet chamber 62 accordingly. Similarly, an outlet adjusting screw 106 can extend across the water evacuation passage 38 to control the flow area of water leaving the outlet chamber 64. This adjustment will raise or lower the pressure in the outlet chamber 64 accordingly and the resulting pressure differential across the rotating dam member 46 will determine the associated rate of the toilet seat descent.

Referring back to FIGS. 3–4, as the toilet seat 16 lowers, the rotating dam member 46 and associated seal member are rotated away from the water evacuation passage 38, and water is evacuated from the outlet chamber 64, causing a rapid pressure drop on the outlet chamber side of the rotating dam member 46. As the water pressure on the outlet chamber side drops to zero, the remaining water pressure on the inlet chamber side maximizes the pressure differential across the rotating dam member 46 and maximizes the resistance to the rotation of the rotating dam member 46 that corresponds to the downward rotation of the toilet seat 16. If the inlet chamber pressure is relatively too high and stops the descent of the toilet seat 16, the evacuation of the outlet chamber 64 can be delayed by the adjustment screw 106 in the water evacuation passage 38, thus reducing the pressure drop across the rotating dam member 46 and allowing the seat 16 to descent.

When the toilet seat 16 reaches its lower, sitting position, the rotating dam member 46 is swung into position over the water inlet passage 36, thereby preventing the further introduction of water to the inlet chamber 62. Subsequently, water in the inlet and outlet chambers 62 and 64 are drained through the water evacuation passage 38.

ALTERNATE EMBODIMENTS

Figure 6:
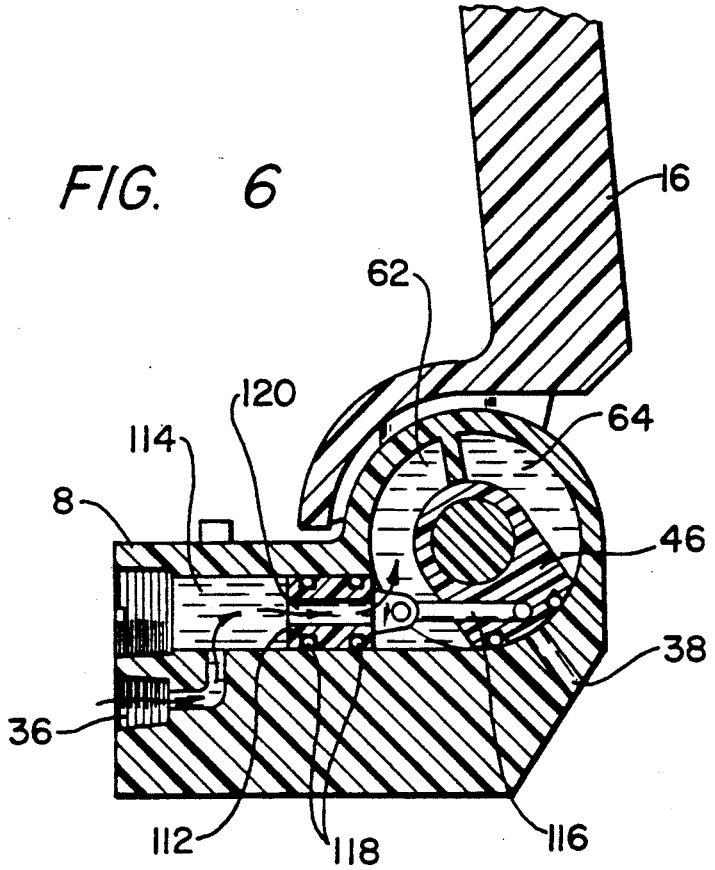
FIG. 6 is a sectional view of another embodiment of the toilet seat lowering apparatus, illustrating the operation of an alternative inlet sealing assembly.

Referring to FIG. 6, the water inlet sealing means of the descent delay assembly can be alternatively embodied in a sliding shutoff member 112 which is reciprocated in an inlet channel 114 by a connecting link 116 pivotally attached to the rotating dam member 46. When the toilet seat 16 is in its lower, sitting position, the rotating dam member 46 is rotated clockwise and urges the sliding shutoff member 112 by the linkage 116 to cove the water inlet passage 36. A series of 0-rings 118 around the circumference of the cylindrical shutoff member 112 facilitate the sliding travel of the shutoff member 112 and further seal the water inlet passage 36.

As illustrated in FIG. 6, when the toilet seat 16 is in its upright position, the rotating dam member 46 is swung to seal the water evacuation passage 38. The shutoff member 112 is pulled from the water inlet passage 36, whereby water flows from the water inlet passage 36 through the inlet channel 114 and enters the inlet chamber 62 through a bore 120 in the center of the shutoff member 112.

The filling and pressurizing process discussed above occurs until both the inlet and outlet chambers 62 and 64 are filled and captured the air is pressurized. Subsequently, the descent initiating means is pressurized and rotates the toilet seat 16 from its upright position to commence the lowering process.

The piston-push pin embodiment of the descent initiating means can be utilized in conjunction with the alternate shutoff assembly illustrated in FIG. 6. Alternatively, an internalized piston 122, as illustrated in FIG. 7, can be utilized to initiate the descent of the toilet seat 16.

Figure 7:
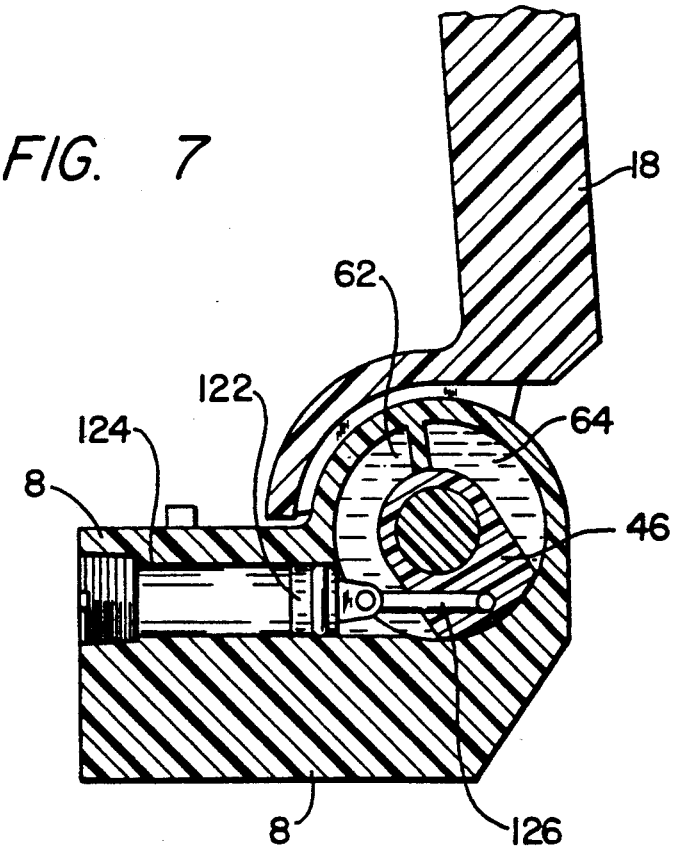
FIG. 7 is a sectional view of another embodiment of a descent initiating assembly.

Referring to FIG. 7, the internalized descent initiating assembly can include the initiating piston 122 slidingly disposed in a cylindrical chamber 124 formed adjacent the inlet chamber 62. The piston 122 can be connected to the rotating dam member 46 by a mechanical link 126. When the inlet chamber 62 and outlet chamber 64 are filled and pressurized to the water supply pressure, a positive pressure differential is created across the initiating piston 122 by the relatively high water pressure in the inlet chamber 62 and the relatively low air pressure in the piston channel 124. The initiating piston 122 is urged by the pressure differential and pulls the rotating dam member 46 clockwise by the mechanical link 126. The toilet seat 18 is correspondingly rotated from its upright position to begin the lowering process.

While specific embodiments of the invention have been described in detail above, it will be appreciated by those skilled in the art that various modifications and alternatives to these details could be developed in light of the overall teachings of this disclosure. For example, one or more water inlet and outlet passages can be provided with associated sealing means. Also, the various embodiments for the sealing means and the descent initiating means or their equivalents can be grouped in different combinations to achieve desired results in particular applications. Accordingly, the particular arrangements disclosed are meant to be illustrative only and not limiting as to the scope of the invention which should be determined by a reasonable interpretation of the appended claims.

I claim:

1. A toilet seat lowering apparatus for automatically lowering a toilet seat from an upright position, said apparatus comprising:

a housing mountable to an upper surface of a toilet bowl, said housing defining an internal cavity, a water inlet passage for permitting the supply of water to said internal cavity, and a water evacuation passage for permitting the drainage of water from said internal cavity;

a descent delay assembly disposed in said internal cavity and providing mounting ends extending outside said housing for operative connection to the toilet seat for constant movement therewith, said descent delay assembly having a rotating dam means for dividing the internal cavity into an inlet chamber and an outlet chamber and defining at least one leakage passage between the inlet chamber and the outlet chamber, said rotating dam means being operatively connected to said mounting ends so that said rotating dam means and the toilet seat rotate together;

means for sealing the water inlet passage when the toilet seat is in a lower position for preventing further introduction of water to said internal cavity, said inlet sealing means being operatively connected to said descent delay assembly for movement to and from said water inlet passage when the toilet is lowered and raised;

means for sealing the water evacuation passage when the toilet seat is in the upright position, said evacuation sealing means being operatively connected to said descent delay assembly for moving to and from said water evacuation passage when the toilet is raised and lowered; and descent initiating means for moving the toilet seat from the upright position and commencing the lowering of the toilet seat.

2. The toilet seat lowering apparatus according to claim 1, wherein said descent initiating means includes:

a piston member slidingly disposed in a chamber extending from said internal cavity, and a connecting member for linking said piston member to said descent delay assembly so that said piston member slides away from said descent delay assembly and urges said descent delay assembly to rotate and commence lowering the toilet seat when water in said internal cavity is pressurized to said supply pressure.

3. A toilet seat lowering apparatus for automatically lowering a toilet seat from an upright position, said apparatus comprising:

a housing mountable to an upper surface of a toilet bowl, said housing defining an internal cavity, a water inlet passage for permitting the supply of water to said internal cavity, and a water evacuation passage for permitting the drainage of water from said internal cavity;

a descent delay assembly disposed in said internal cavity and providing with mounting ends extending outside said housing for connection to the toilet seat, said descent delay assembly including a stationary dam member connected to an internal cavity wall of said housing and a rotating dam member rotatably mounted in said housing and operatively connected to said mounting ends so that said rotating dam member and the toilet seat rotate together, said rotating dam member and said stationary dam member dividing said internal cavity into an inlet chamber and an outlet chamber, said stationary dam member and said rotating dam member being spaced to define a first leakage passage between said inlet and outlet chambers, said rotating dam member being spaced from said internal cavity wall to define a second leakage passage between said inlet and outlet chambers;

means for sealing the water inlet passage when the toilet seat is in a lowered position for preventing further introduction of water to said internal cavity, said inlet sealing means being operatively connected to said descent delay assembly for movement to and from said water inlet passage when the toilet seat is lowered and raised;

means for sealing the water evacuation passage when the toilet seat is in the upright position, said evacuation sealing means being operatively connected to said descent delay assembly for movement to and from said water evacuation passage when the toilet seat is raised and lowered; and a descent initiating means for moving the toilet seat from the upright position, said descent initiating means being activated when said inlet and outlet chambers are substantially filled with water, and are pressurized to a supply pressure of the water.

4. The toilet seat lowering apparatus according to claim 3, wherein said evacuation sealing means includes a sealing member mounted on a sweeping face of said rotating dam member adjacent said internal cavity wall, whereby said sealing member is swung into sealing engagement with said water evacuation passage when said rotating dam member is rotated by the raising of the toilet seat to said upright position.

5. The toilet seat lowering apparatus according to claim 4, wherein said sealing member is a flexible 0-ring mounted in a circular groove of said sweeping face.

6. The toilet seat lowering apparatus according to claim 4, wherein said sealing member also serves as said inlet sealing means.

7. The toilet seat lowering apparatus of claim 6, wherein the sealing member includes a seal assembly including a circular body having a peripheral sealing ring for sealingly inserting inwardly in a corresponding hole in said sweeping face, said circular body providing an 0-ring on its outer surface and a central bore which expands inwardly to form an annular shelf, whereby water from said water inlet passage can enter said hole through said bore and exert outwardly directed pressure on said annular shelf to increase the seal of said water inlet passage.

8. The toilet seat lowering apparatus according to claim 3, wherein said inlet sealing means includes a shutoff member slidingly disposed in an inlet channel extending from a side of said internal cavity, said water inlet passage connecting to said inlet channel, said shutoff member operatively connecting to said descent delay assembly so that lowering the toilet seat to the lowered position moves said shutoff member over said water inlet passage and raising said toilet seat to said upright position moves said shutoff member away from said water inlet passage, thereby permitting passage of water to said internal cavity through a bore in said shutoff member.

9. The toilet seat lowering apparatus according to claim 3, wherein said descent initiating means includes:

a push pin reciprocally positioned in a piston chamber in said housing, said push pin extending through an aperture in said housing to engage the toilet seat;

a piston in said piston chamber connected to the push pin, said piston being urged toward the toilet seat when said piston chamber is filled with water through a piston chamber passage from said internal cavity and the water is pressurized to said supply pressure.

10. The toilet seat lowering apparatus of claim 9, further comprising adjustment means for variably constricting the piston chamber passage to control the delay in activation of the descent initiating means.

11. The toilet seat lowering apparatus of claim 10, wherein said adjustment means is an adjustment screw variably extending across said piston chamber passage.

12. The toilet seat lowering apparatus according to claim 3, further comprising descent adjustment means for controlling delay time in actuation of the descent initiating means and the rate of descent of the toilet seat.

13. The toilet seat lowering apparatus according to claim 12, wherein said descent adjustment means includes an adjusting screw variably extending across said water inlet passage.

14. The toilet seat lowering apparatus according to claim 13, wherein said descent adjustment means further includes a second adjusting screw variably extending across said water evacuation passage.

15. The toilet seat lowering apparatus according to claim 3, wherein said descent delay assembly further includes a mounting shaft removably extending through said rotating dam member and providing said mounting ends, said shaft being rotationally fixed relative to said rotating dam member.

* * * * *